US011440714B2

(12) United States Patent
Wang

(10) Patent No.: US 11,440,714 B2
(45) Date of Patent: Sep. 13, 2022

(54) LOCKABLE AND MOISTURE-PROOF PILL BOX

(71) Applicant: E-LINK PLASTIC & METAL INDUSTRIAL CO., LTD., New Taipei (TW)

(72) Inventor: You Lin Wang, New Taipei (TW)

(73) Assignee: E-Link Plastic & Metal Industrial Co., LTD., New Taipei (TW)

( * ) Notice: Subject to any disclaimer, the term of this patent is extended or adjusted under 35 U.S.C. 154(b) by 72 days.

(21) Appl. No.: 16/950,167

(22) Filed: Nov. 17, 2020

(65) Prior Publication Data

US 2022/0153491 A1 May 19, 2022

(51) Int. Cl.

| | |
|---|---|
| ***B65D 55/02*** | (2006.01) |
| ***A61J 1/03*** | (2006.01) |
| ***B65D 43/16*** | (2006.01) |
| ***B65D 43/26*** | (2006.01) |

(52) U.S. Cl.

CPC ..... *B65D 55/02* (2013.01); *A61J 1/03* (2013.01); *B65D 43/164* (2013.01); *B65D 43/267* (2013.01); *B65D 2255/20* (2013.01); *B65D 2543/00888* (2013.01); *B65D 2543/00972* (2013.01)

(58) Field of Classification Search

CPC .... B65D 55/02; B65D 43/164; B65D 43/267; B65D 2255/20; B65D 2543/00888; B65D 2543/00972; B65D 75/327; B65D 83/04; A61J 1/03; A61J 7/0084

USPC ..... 206/1.5, 528, 530, 533, 534, 538, 539, 206/540, 804; 220/23.8

See application file for complete search history.

(56) References Cited

U.S. PATENT DOCUMENTS

| | | | | | |
|---|---|---|---|---|---|
| 4,166,537 | A * | 9/1979 | Fortunato | A61J 1/03 | 206/535 |
| 4,685,579 | A * | 8/1987 | Stapleton | B65D 55/066 | 206/532 |
| 4,866,952 | A * | 9/1989 | Hight | A44C 25/002 | 220/795 |
| 5,908,037 | A * | 6/1999 | Pierson | A45C 13/008 | 132/304 |
| 6,000,546 | A * | 12/1999 | Noble | A61J 1/03 | 206/538 |
| 6,655,544 | B1 * | 12/2003 | Tanaka | B65D 43/24 | 220/254.1 |
| 7,494,012 | B1 * | 2/2009 | Priebe | B65D 83/0445 | 206/538 |

(Continued)

*Primary Examiner* — Chun Hoi Cheung
*Assistant Examiner* — Brijesh V. Patel
(74) *Attorney, Agent, or Firm* — Apex Juris, pllc; Hilde Coeckx

(57) ABSTRACT

A lockable and moisture-proof pill box has a storing base having at least one compartment for holding pills, at least one lid pivotally mounted on the storing base, and at least one sealing and pushing member. Each of the at least one lid has a sealing ring and a pushing bar integrally formed as a single part. With the at least one sealing and pushing member mounted between the storing base and the at least one lid, the at least one compartment in the storing base can be airtightly sealed by the sealing ring when being closed, so as to prevent the pills in the at least one compartment from being spilt. Moreover, each of the at least one lid can be automatically opened by push of the pushing bar. Thus, a user can take the pills held in the compartment easily and conveniently.

8 Claims, 7 Drawing Sheets

(56) References Cited

U.S. PATENT DOCUMENTS 7,624,890 B2 * 12/2009 Noble ..... B65D 83/0445 206/538
8,381,911 B2 * 2/2013 Buchner ..... B65D 83/04 206/530
D691,366 S * 10/2013 Muncy ..... D3/203.3
9,944,437 B2 * 4/2018 Lin ..... B65D 43/02
D831,331 S * 10/2018 Lee ..... D3/203.3
D833,733 S * 11/2018 Chen ..... D3/203.3
10,420,703 B1 * 9/2019 Lee ..... A61J 7/0084
D898,344 S * 10/2020 Lee ..... D3/203.3
D898,345 S * 10/2020 Lee ..... D3/203.3
2003/0043026 A1 * 3/2003 Noble ..... A61J 7/0472 340/309.16
2004/0089581 A1 * 5/2004 Dienst ..... B65D 83/0445 206/538
2005/0258174 A1 * 11/2005 Giraud ..... B65D 43/163 220/4.21
2009/0114653 A1 * 5/2009 Schenker ..... B65D 25/32 220/789
2009/0200307 A1 * 8/2009 Giraud ..... B65D 50/04 220/326
2010/0044270 A1 * 2/2010 Noble ..... B65D 83/04 206/538
2012/0097678 A1 * 4/2012 Giraud ..... B65D 43/162 220/260
2013/0021878 A1 * 1/2013 Harris ..... G04F 1/005 368/10
2013/0056385 A1 * 3/2013 Thompson ..... A61J 7/04 206/534
2014/0042052 A1 * 2/2014 Tsai ..... A61J 7/0481 206/534
2014/0251861 A1 * 9/2014 Priebe ..... A61J 7/04 206/534
2014/0251862 A1 * 9/2014 Priebe ..... A61J 1/03 206/534
2014/0251863 A1 * 9/2014 Priebe ..... A61J 1/03 206/534

* cited by examiner

LOCKABLE AND MOISTURE-PROOF PILL BOX

BACKGROUND OF THE INVENTION

1. Field of the Invention

The present invention relates to a pill box, especially to a lockable and moisture-proof pill box.

2. Description of the Prior Art(s)

A pill box has multiple compartments for storing scheduled doses of medications, so as to prevent or reduce medication errors on the part of the patient.

A conventional pill box substantially comprises a container and multiple lids. An interior of the container is divided into multiple compartments. The lids selectively cover the compartments respectively. Each of the lids has a connecting end edge and a distal end edge oppositely defined on the lid. The connecting end edge of the lid is pivotally connected with the container. The distal end edge of the lid is able to detachably engage with the container, so as to close a corresponding one of the compartments. When the distal end edge of the lid disengages from the container, the lid can be opened relative to the container, such that pills in a corresponding one of the compartment can be taken out.

However, since most kinds of the pills are deliquescent and thus are spoilt easily, it is important to provide a sealing structure between the container and each lid. In addition, the container and the lids are made of rigid plastic material. When the lids are in a closed position to close the compartments, the lids are slightly deformed and bent. When the distal end edge of the lid disengages from the container, the lid spring open due to the force generated by the deformation of the lid. Accordingly, the lid cannot be completely opened and an opening angle of the lid relative to the container is not sufficient for a user to take the pills. Consequently, it is inconvenient to take the pills out from the compartment. In addition, the lids are easily damaged because the lids are deformed and bent at the closed position most of the time.

To overcome the shortcomings, the present invention provides a lockable and moisture-proof pill box to mitigate or obviate the aforementioned problems.

SUMMARY OF THE INVENTION

The main objective of the present invention is to provide a lockable and moisture-proof pill box. The lockable and moisture-proof pill box has a storing base, at least one lid, and at least one sealing and pushing member.

The storing base has at least one compartment, at least one mounting groove, and at least one first locking protrusion. The at least one compartment is defined in the storing base. Each of the at least one compartment forms an opening on an upper surface of the storing base. The at least one mounting groove is formed in the upper surface of the storing base. Each of the at least one mounting groove is disposed around the opening of a corresponding one of the at least one compartment. The at least one first locking protrusion is formed on and protrudes from a front wall of the storing base. Each of the at least one first locking protrusion corresponds in position to a corresponding one of the at least one compartment.

The at least one lid is pivotally mounted on the storing base. Each of the at least one lid has a rear end pivotally connected to the rear wall of the storing base, a sealing groove formed in an inner surface of the lid, and a second locking protrusion. The second locking protrusion is formed on and protruding from a front end of the lid and selectively engages with a corresponding one of the first locking protrusion of the storing base.

The at least one sealing and pushing member is elastic. Each of the at least one sealing and pushing member has a sealing ring and a pushing bar. The sealing ring is mounted in a corresponding one of the mounting groove of the storing base and protrudes out of the corresponding mounting groove.

The pushing bar extends from the sealing ring and protrudes toward and abuts against the inner surface of a corresponding one of the at least one lid. The sealing ring and the pushing bar are integrally formed as a single part. When the lid pivots to a close position to close a corresponding one of the at least one compartment, the sealing ring that is disposed around the corresponding compartment further protrudes into the sealing groove of the lid.

With the at least one sealing and pushing member mounted between the storing base and the at least one lid, the at least one compartment in the storing base can be airtightly sealed by the sealing ring when being closed, so as to prevent the pills, such as medicines or vitamins, in the at least one compartment from being spilt. Moreover, each of the at least one lid can be automatically opened by push of the pushing bar. Thus, a user can take the pills held in the compartment easily and conveniently. Furthermore, since the sealing ring and the pushing bar are integrally formed as a single part, it is simple for a manufacturer to assemble the at least one lid onto the storing base.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
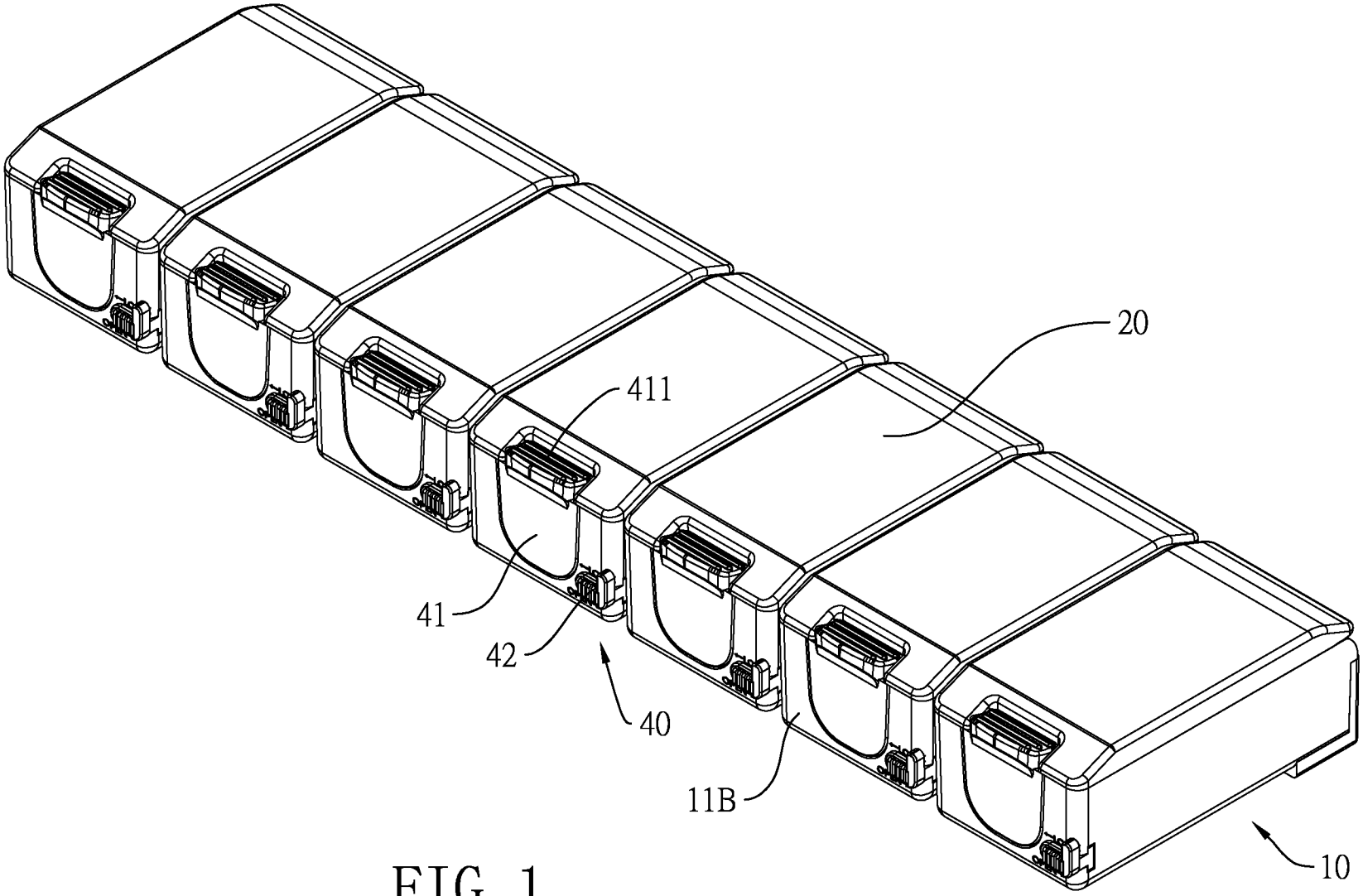
FIG. 1 is a perspective view of a lockable and moisture-proof pill box in accordance with the present invention.
Figure 2:
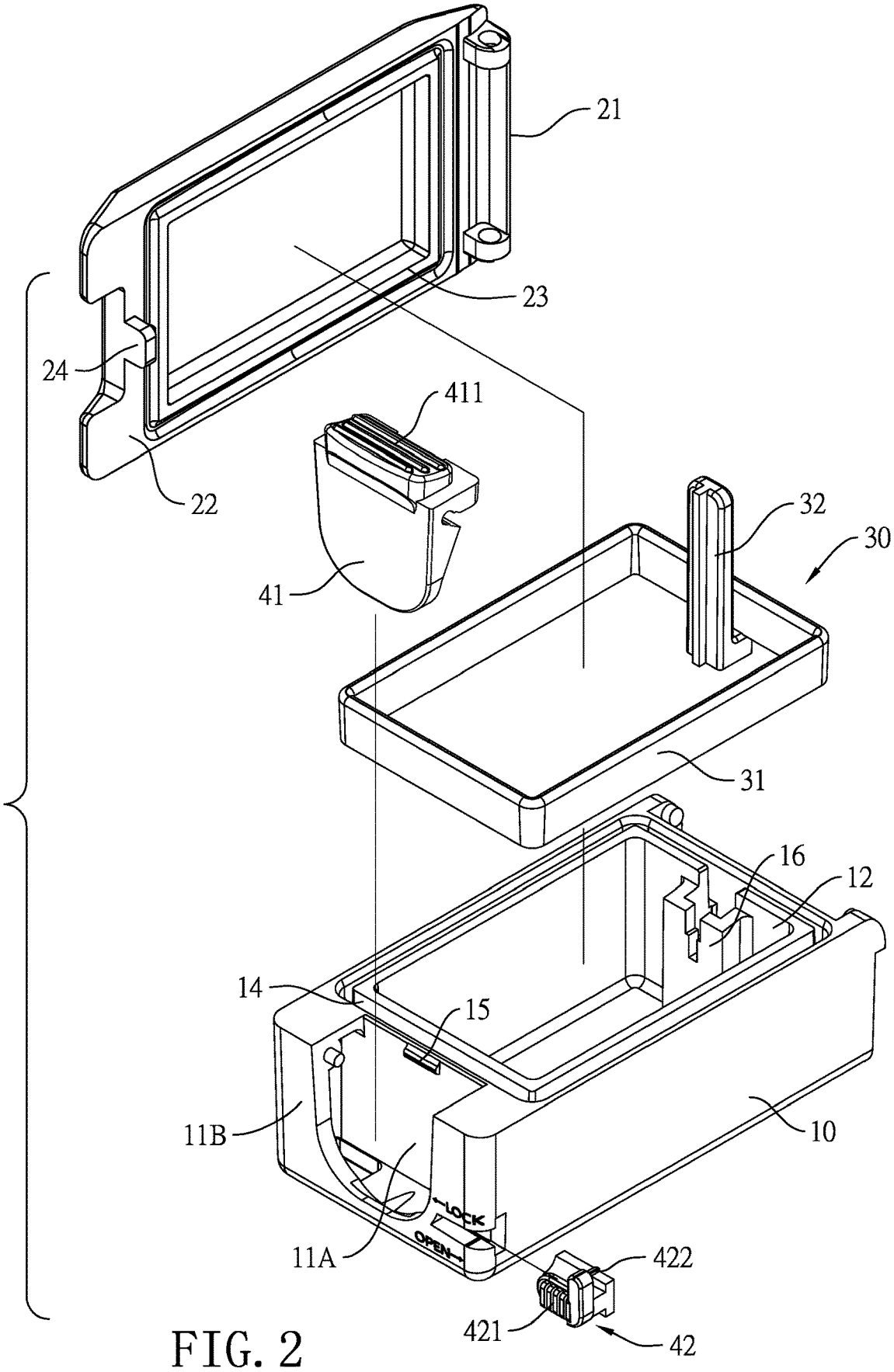
FIG. 2 is an enlarged exploded perspective view of the lockable and moisture-proof pill box in FIG. 1.

With reference to FIGS. 1 and 2, a lockable and moisture-proof pill box in accordance with the present invention comprises a storing base 10, at least one lid 20, at least one sealing and pushing member 30, and at least one limiting assembly 40.

The a storing base 10 has an upper surface, a front wall 11A, a rear wall 12, an additional front wall 11B, at least one compartment 13, at least one mounting groove 14, and at least one first locking protrusion 15.

The front wall 11A and the rear wall 12 are oppositely defined on the storing base 10. The additional front wall 11B is separately formed in front of the front wall 11A, such that a gap is defined between the front wall 11A and the additional front wall 11B. The at least one compartment 13 is defined in the storing base 10 for holding pills inside the pill box. Each of the at least one compartment 13 forms an opening on the upper surface of the storing base 10.

The at least one mounting groove 14 is formed in the upper surface of the storing base 10. Each of the at least one mounting groove 14 is annular and is disposed around the opening of a corresponding one of the at least one compartment 13. The at least one first locking protrusion 15 is formed on and protrudes from the front wall 11A of the storing base 12. Each of the at least one first locking protrusion 15 corresponds in position to a corresponding one of the at least one compartment 13.

As shown in FIG. 2, the at least one lid 20 are pivotally mounted on the storing base 10 and selectively closes the at least one compartment 13 respectively. Each of the at least one lid 20 has a front end, a rear end 21, an inner surface 22, a sealing groove 23, and a second locking protrusion 24.

The front end of the lid 20 is positioned toward the front wall 11A of the storing base 10. The rear end 21 of the lid 20 is positioned toward and is pivotally connected to the rear wall 12 of the storing base 10. The inner surface 22 of the lid 20 faces a corresponding one of the at least one compartment 13. The sealing groove 23 is annular and is formed in the inner surface of the lid 20.

Figure 3:
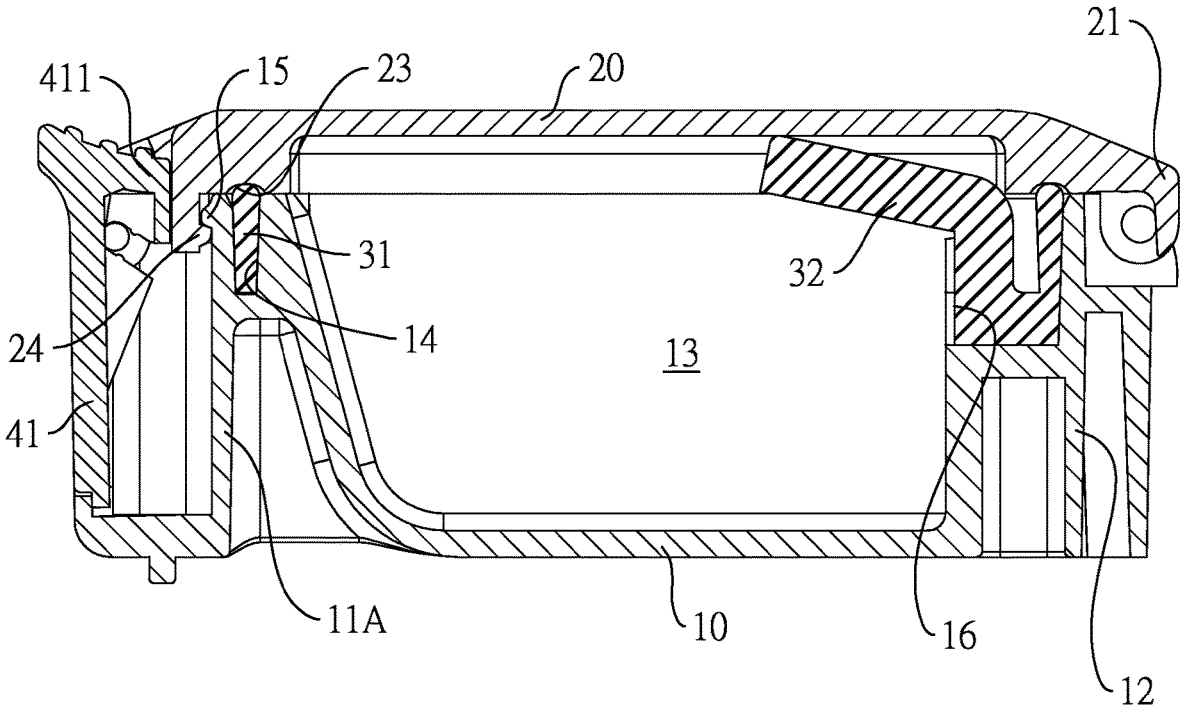
FIG. 3 is a cross-sectional side view of the lockable and moisture-proof pill box in FIG. 1, shown closed.

With further reference to FIG. 3, the second locking protrusion 24 is formed on and protrudes from the front end of the lid 20 and selectively engages with a corresponding one of the first locking protrusion 15 of the storing base 10.

Figure 4:
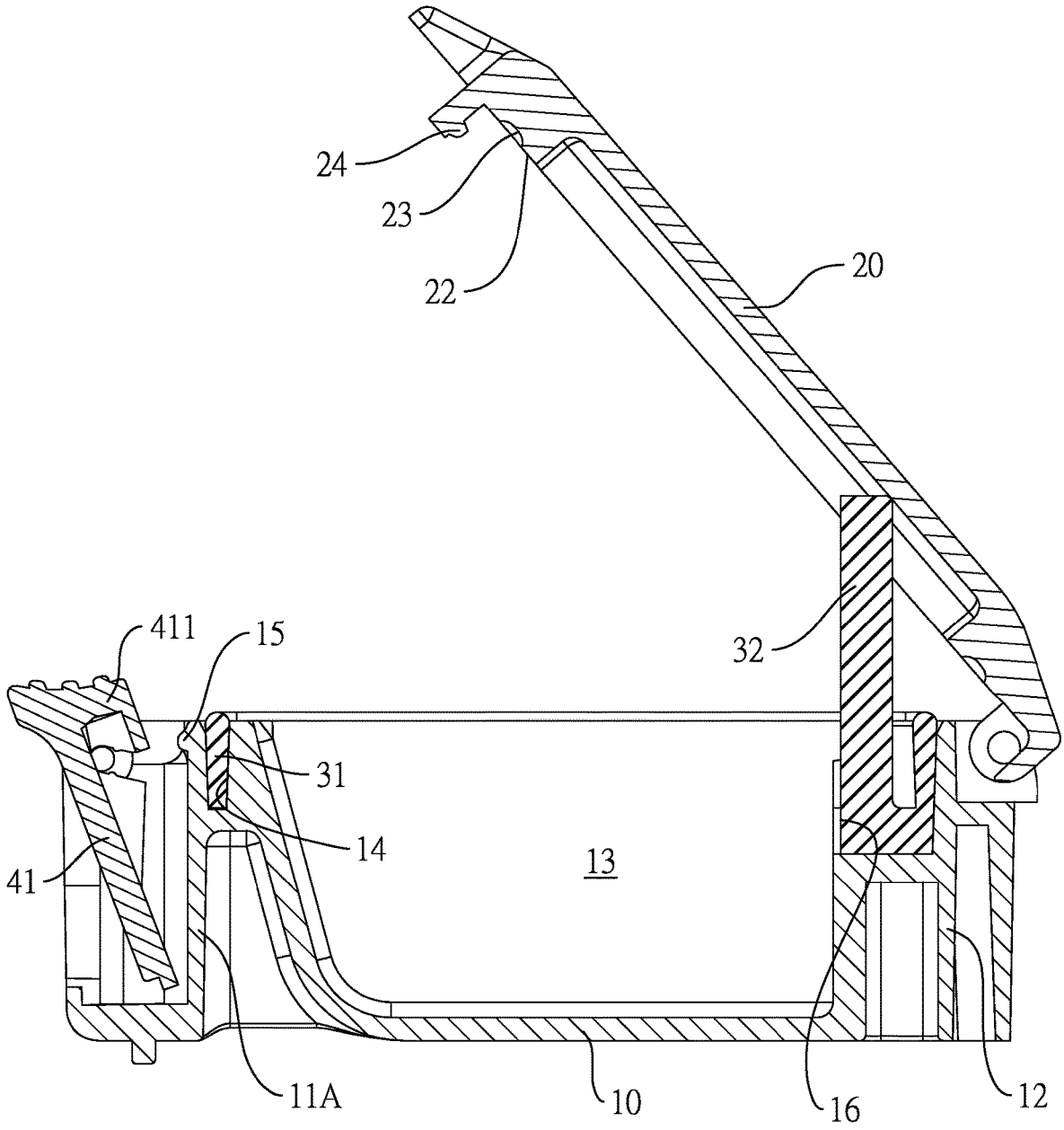
FIG. 4 is a cross-sectional side view of the lockable and moisture-proof pill box in FIG. 1, shown opened.

With reference to FIGS. 2 to 4, the at least one sealing and pushing member 30 is elastic, may be made of silicone, and is mounted on the upper surface of the storing base 10. Each of the at least one sealing and pushing member 30 has a sealing ring 31 and a pushing bar 32. The sealing ring 31 and the pushing bar 32 are integrally formed as a single part. The sealing ring 31 is annular, is mounted in a corresponding one of the mounting groove 14 of the storing base 10, and protrudes out of the corresponding mounting groove 14. The pushing bar 32 extends from the sealing ring 31 and protrudes toward and abuts against the inner surface of a corresponding one of the at least one lid 20.

As shown in FIG. 3, when the lid 20 pivots to a close position to close the corresponding compartment 13 of the storing base 10, the sealing ring 31 that is disposed around the corresponding compartment 13 further protrudes into the sealing groove 23 of the lid 20, so as to airtightly seal the corresponding compartment 13. Moreover, the corresponding pushing bar 32 is deformed and the second locking protrusion 24 of the lid 20 engages with the corresponding first locking protrusion 15 of the storing base 10 to stop the lid 20 from opening.

As shown in FIG. 4, when the second locking protrusion 24 of the lid 20 disengages from the corresponding first locking protrusion 15 of the storing base 10, the corresponding pushing bar 32 is restored and a resilient restoring force provided by the pushing bar 32 pushes the lid 20 to automatically pivot relative to the storing base 10. With the resilient restoring force provided by the pushing bar 32, the lid 20 is completely opened.

Preferably, the storing base 10 further has at least one insertion socket 16 formed on the rear wall 12 of the storing base 10. Each of the at least one insertion socket 16 is disposed in a corresponding one of the at least one compartment 13. A lower end of the pushing bar 32 of each sealing and pushing member 30 is inserted into a corresponding one of the at least one insertion socket 16, such that the pushing bar 32 is stably mounted on the storing base 10.

Figure 5:
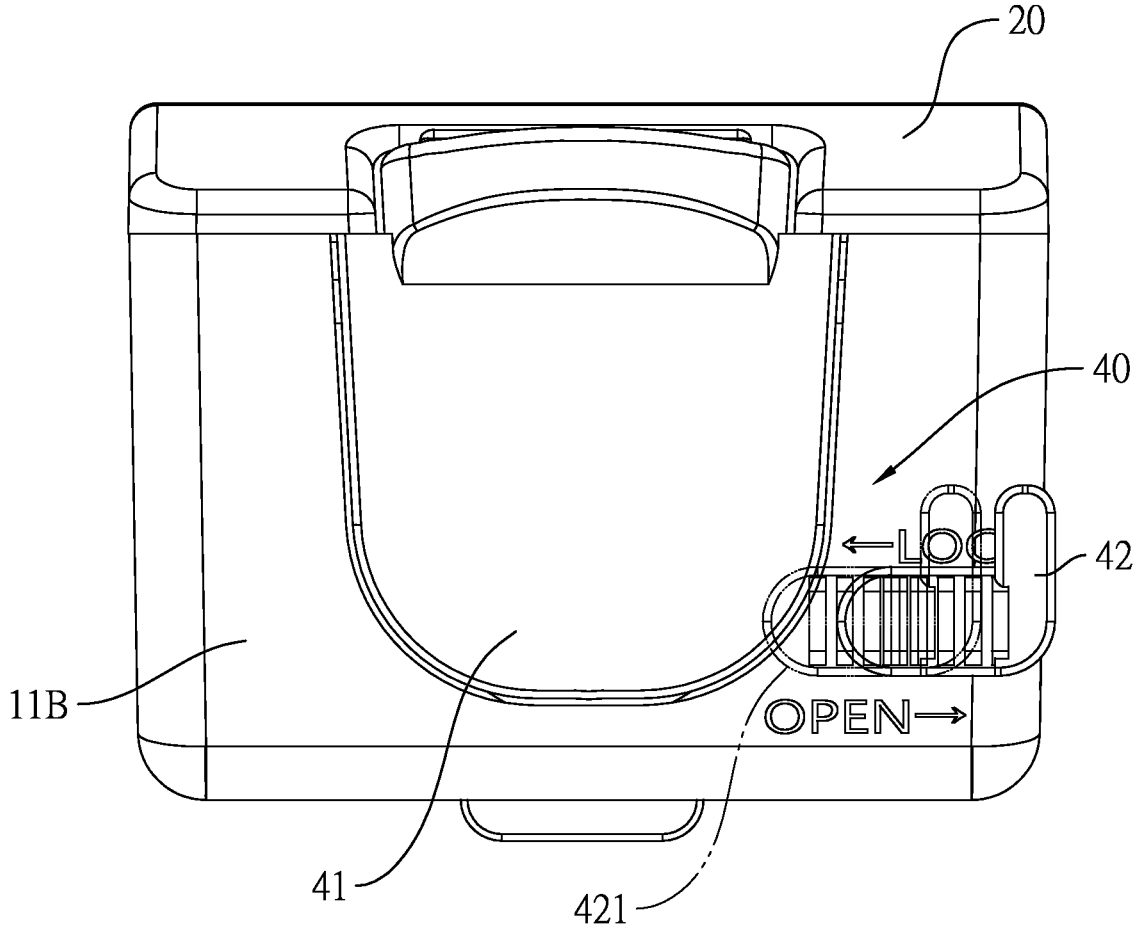
FIG. 5 is an enlarged operational front view of the lockable and moisture-proof pill box in FIG. 1.

With reference to FIGS. 2, 4, and 5, the at least one limiting assembly 40 is mounted to the additional front wall 11B. Each of the at least one limiting assembly 40 corresponds in position to a corresponding one of the at least one compartment 13 and has a limiting button 41 and a holding member 42.

The limiting button 41 is pivotally mounted to the additional front wall 11B of the storing base 10 and has an abutting protrusion 411. The abutting protrusion 411 is formed on an upper end of the limiting button 41 and protrudes toward the front wall 11A of the storing base 10.

Figure 6:
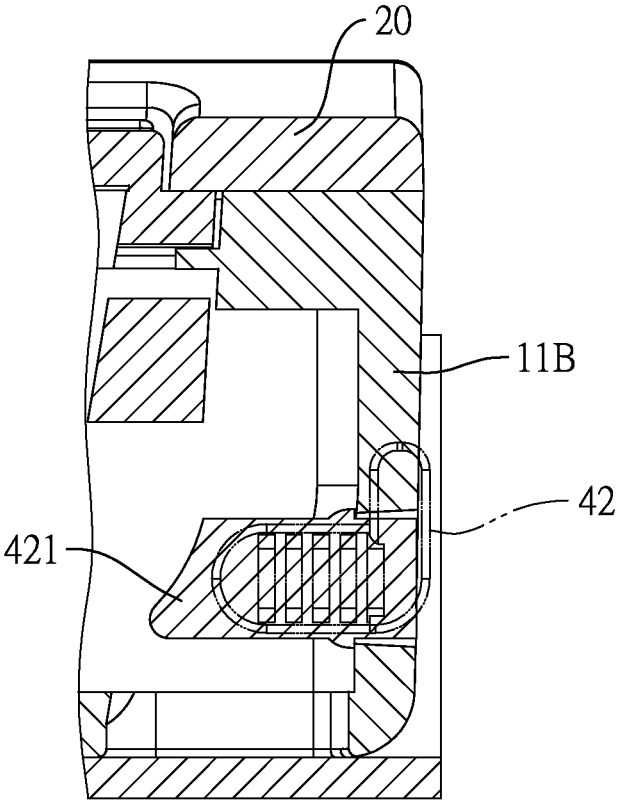
FIG. 6 is an enlarged cross-sectional front view of the lockable and moisture-proof pill box in FIG. 1.
Figure 7:
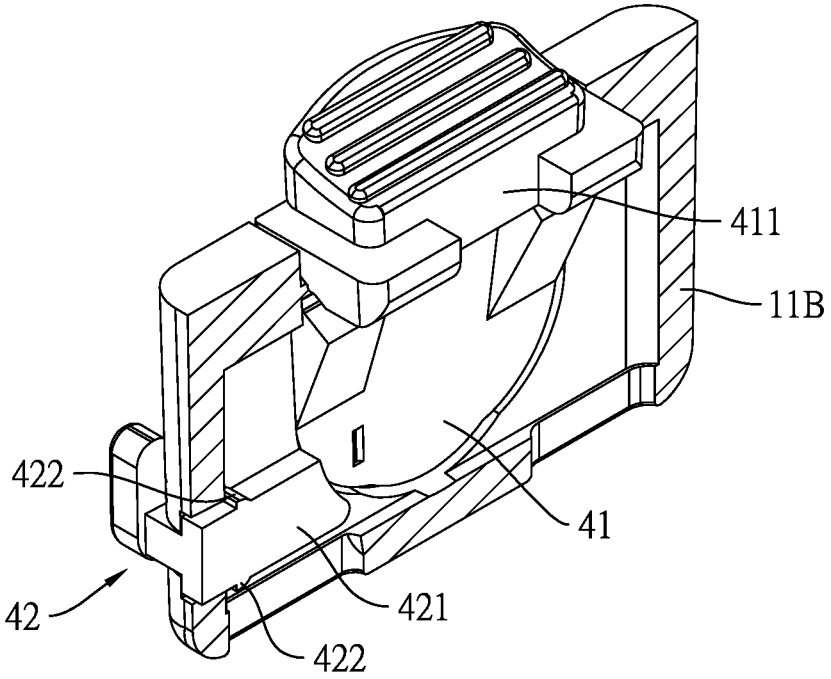
FIG. 7 is an enlarged cross-sectional perspective view of the lockable and moisture-proof pill box in FIG. 1, shown unlocked.
Figure 8:
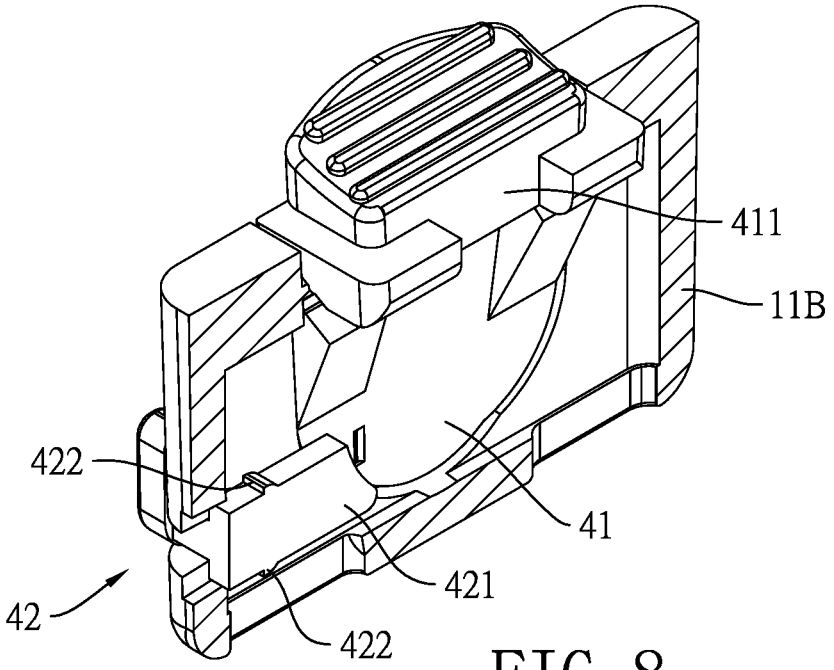
FIG. 8 is an enlarged cross-sectional perspective view of the lockable and moisture-proof pill box in FIG. 1, shown locked.

With further reference to FIGS. 6 to 8, the holding member 42 is slidably mounted in the additional front wall 11B of the storing base 10 and selectively holds the limiting button 41 to stop the limiting button 41 from pivoting. The holding member 42 has two holding arms 421 and at least one stop protrusions 422.

The two holding arms 421 separately extend toward the limiting button 41. As shown in FIG. 8, when the holding member 42 slides to a locking position, the limiting button 41 is held between the two holding arms 421. Thus, the limiting button 41 is unable to pivot.

The at least one stop protrusion 422 selectively abuts on an inner surface of the additional wall 11B of the storing base 10. As shown in FIG. 7, when the holding member 42 slides to an unlocking position, the at least one stop protrusion 422 abuts on the inner surface of the additional wall 11B of the storing base 10, such that the holding member 42 does not drop from the storing base 10. Moreover, when the holding member 42 slides to the unlocking position, the limiting button 41 is free from being held by the two holding arms 421 and is able to pivot relative to the storing base 10.

As shown in FIG. 3, when the lid 20 pivots to the close position, in addition to engaging with the corresponding first locking protrusion 15 of the storing base 10, the second locking protrusion 24 of the lid 20 also pushes the abutting protrusion 411 of the limiting button 41 of a corresponding one of the at least one limiting assembly 40 to pivots toward the front wall 11A of the storing base 10. Thus, the second locking protrusion 24 of the lid 20 is held between the abutting protrusion 411 of the limiting button 41 and the front wall 11A of the storing base 10. Furthermore, by pushing the holding member 42 to the locking position, the limiting button 41 is held by the two holding arms 421 of the holding member 42 and is unable to pivot relative to the storing base 10.

The lockable and moisture-proof pill box as described has the following advantages. With the at least one sealing and pushing member 30 mounted between the storing base 10 and the at least one lid 20, the at least one compartment 13 in the storing base 10 can be airtightly sealed by the sealing ring 31 when being closed, so as to prevent the pills, such as medicines or vitamins, in the at least one compartment 13 from being spilt. Moreover, each of the at least one lid 20 can be automatically opened by push of the pushing bar 32. Thus, a user can take the pills held in the compartment 13 easily and conveniently. Furthermore, since the sealing ring 31 and the pushing bar 32 are integrally formed as a single part, it is simple for a manufacturer to assemble the at least one lid onto the storing base 10.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lockable and moisture-proof pill box comprising:

a storing base having a front wall;

a rear wall;

at least one compartment defined in the storing base, and each of the at least one compartment forming an opening on an upper surface of the storing base;

at least one mounting groove formed in the upper surface of the storing base, and each of the at least one mounting groove being annular and disposed around the opening of a corresponding one of the at least one compartment; and at least one first locking protrusion formed on and protruding from the front wall of the storing base, and each of the at least one first locking protrusion corresponding in position to a corresponding one of the at least one compartment;

at least one lid pivotally mounted on the storing base, and each of the at least one lid having a front end;

a rear end pivotally connected to the rear wall of the storing base;

a sealing groove being annular and formed in an inner surface of the lid; and a second locking protrusion formed on and protruding from the front end of the lid and selectively engaging with a corresponding one of the first locking protrusion of the storing base; and at least one sealing and pushing member being elastic, and each of the at least one sealing and pushing member having a sealing ring being annular, mounted in a corresponding one of the mounting groove of the storing base, and protruding out of the corresponding mounting groove; and a pushing bar extending from the sealing ring and protruding toward and abutting against the inner surface of a corresponding one of the at least one lid, wherein the sealing ring and the pushing bar are integrally formed as a single part;

when the lid pivots to a close position to close a corresponding one of the at least one compartment, the sealing ring that is disposed around the corresponding compartment further protrudes into the sealing groove of the lid.

2. The lockable and moisture-proof pill box as claimed in claim 1, wherein the storing base further has an additional front wall separately formed in front of the front wall; and the lockable and moisture-proof pill box further comprises at least one limiting assembly mounted to the additional front wall of the storing base, each of the at least one limiting assembly corresponds in position to a corresponding one of the at least one compartment and has a limiting button pivotally mounted to the additional front wall and having an abutting protrusion, and the abutting protrusion is formed on an upper end of the limiting button and protrudes toward the front wall of the storing base;

when the lid pivots to the close position, the second locking protrusion of the lid is held between the abutting protrusion of the limiting button of a corresponding one of the at least one limiting assembly and the front wall of the storing base.

3. The lockable and moisture-proof pill box as claimed in claim 2, wherein each of the at least one limiting assembly further has a holding member slidably mounted in the additional front wall of the storing base and selectively holding the limiting button.

4. The lockable and moisture-proof pill box as claimed in claim 3, wherein the holding member of each of the at least one limiting assembly has two holding arms separately extending toward the limiting button, wherein when the holding member slides to a locking position, the limiting button is held between the two holding arms; and at least one stop protrusions, wherein when the holding member slides to an unlocking position, the at least one stop protrusion abuts on an inner surface of the additional wall of the storing base.

5. The lockable and moisture-proof pill box as claimed in claim 4, wherein the storing base further has at least one insertion socket formed on the rear wall of the storing base, and each of the at least one insertion socket is disposed in a corresponding one of the at least one compartment; and a lower end of the pushing bar of each sealing and pushing member is inserted into a corresponding one of the at least one insertion socket.

6. The lockable and moisture-proof pill box as claimed in claim 3, wherein the storing base further has at least one insertion socket formed on the rear wall of the storing base, and each of the at least one insertion socket is disposed in a corresponding one of the at least one compartment; and a lower end of the pushing bar of each sealing and pushing member is inserted into a corresponding one of the at least one insertion socket.

7. The lockable and moisture-proof pill box as claimed in claim 2, wherein the storing base further has at least one insertion socket formed on the rear wall of the storing base, and each of the at least one insertion socket is disposed in a corresponding one of the at least one compartment; and a lower end of the pushing bar of each sealing and pushing member is inserted into a corresponding one of the at least one insertion socket.

8. The lockable and moisture-proof pill box as claimed in claim 1, wherein the storing base further has at least one insertion socket formed on the rear wall of the storing base, and each of the at least one insertion socket is disposed in a corresponding one of the at least one compartment; and a lower end of the pushing bar of each sealing and pushing member is inserted into a corresponding one of the at least one insertion socket.

* * * * *